US008590982B2

(12) United States Patent
Holme

(10) Patent No.: US 8,590,982 B2
(45) Date of Patent: Nov. 26, 2013

(54) LONGWALL MINING ROOF SUPPORTS

(75) Inventor: John Holme, Lancashire (GB)

(73) Assignee: Joy MM Delaware, Inc., Wilmington, DE (US)

( * ) Notice: Subject to any disclaimer, the term of this patent is extended or adjusted under 35 U.S.C. 154(b) by 341 days.

(21) Appl. No.: 12/833,291

(22) Filed: Jul. 9, 2010

(65) Prior Publication Data

US 2011/0006586 A1 Jan. 13, 2011

Related U.S. Application Data

(60) Provisional application No. 61/224,762, filed on Jul. 10, 2009.

(51) Int. Cl.
*E21D 9/08* (2006.01)
*E21D 23/00* (2006.01)

(52) U.S. Cl.
USPC ..... 299/33; 299/1.7

(58) Field of Classification Search
USPC ..... 299/33, 64, 65; 405/288, 290, 293–296
See application file for complete search history.

(56) References Cited

U.S. PATENT DOCUMENTS

| | | | |
|---|---|---|---|
| 3,218,811 | A | 11/1965 | Barall et al. |
| 3,370,431 | A | 2/1968 | Adcock et al. |
| 3,578,809 | A | 5/1971 | Cunningham |
| 3,606,758 | A | 9/1971 | Gotze |
| 3,656,810 | A | 4/1972 | Khodosh et al. |
| 3,672,174 | A | 6/1972 | Hippel |
| 3,739,586 | A | 6/1973 | Wehner et al. |
| 3,848,420 | A | 11/1974 | Allen et al. |

(Continued)

FOREIGN PATENT DOCUMENTS

| | | |
|---|---|---|
| AU | 200123147 | 8/2001 |
| AU | 200123148 | 8/2001 |

(Continued)

OTHER PUBLICATIONS

PCT/US2010/041482 International Search Report and Written Opinion dated Aug. 31, 2010, 10 pages.

(Continued)

*Primary Examiner* — David Bagnell
*Assistant Examiner* — Kyle Armstrong
(74) *Attorney, Agent, or Firm* — Michael Best & Freidrich LLP

(57) ABSTRACT

A longwall mining system includes at least one face end roof support having a longitudinal length, and at least one near end roof support adjacent the face end roof support. The near end roof support has a longitudinal length substantially shorter than the face end roof support longitudinal length. There is also at least one face roof support adjacent the near end roof support, and the face roof support has a longitudinal length substantially shorter than the near end roof support longitudinal length. There is also a forward conveyor extending forward to and attached to the face end roof support, the at least one near end roof support, and the at least one face roof support, and a rearward conveyor extending rearward of and attached to the face end roof support, the at least one near end roof support, and the at least one face roof support. This creates an effective cave line at an angle to the coal face, that helps reduce the goaf pressure on the face end, thereby increasing the stability of the main gate roof support.

6 Claims, 13 Drawing Sheets

(56) References Cited

U.S. PATENT DOCUMENTS

| | | | | |
|---|---|---|---|---|
| 3,890,792 | A * | 6/1975 | Alacchi | 405/298 |
| 3,891,275 | A | 6/1975 | Spies | |
| 3,896,626 | A | 7/1975 | Spies et al. | |
| 3,903,703 | A | 9/1975 | Lubojatsky | |
| 3,915,500 | A | 10/1975 | Schlusener et al. | |
| 3,932,998 | A | 1/1976 | Lubojatsky et al. | |
| 3,949,563 | A | 4/1976 | Wertelewski et al. | |
| 3,971,225 | A | 7/1976 | Wertelewski et al. | |
| 3,983,709 | A | 10/1976 | Koppers | |
| 4,003,208 | A | 1/1977 | Hornung et al. | |
| 4,008,578 | A | 2/1977 | Blumenthal et al. | |
| 4,010,618 | A | 3/1977 | Walker et al. | |
| 4,026,116 | A | 5/1977 | Purcupile et al. | |
| 4,028,898 | A | 6/1977 | Blumenthal et al. | |
| 4,030,752 | A | 6/1977 | Simpson | |
| 4,041,715 | A | 8/1977 | Watermann et al. | |
| 4,065,929 | A | 1/1978 | Simpson | |
| 4,077,223 | A | 3/1978 | Koppers et al. | |
| 4,080,794 | A | 3/1978 | Neu | |
| 4,094,153 | A | 6/1978 | Blumenthal et al. | |
| 4,094,154 | A | 6/1978 | Blumenthal et al. | |
| 4,102,140 | A | 7/1978 | Allen | |
| 4,136,999 | A | 1/1979 | Koppers | |
| 4,146,271 | A | 3/1979 | Ward | |
| 4,183,700 | A | 1/1980 | von Klinggraff et al. | |
| 4,185,940 | A | 1/1980 | Spies | |
| 4,197,035 | A | 4/1980 | Siebenhofer et al. | |
| 4,199,193 | A | 4/1980 | Damron et al. | |
| 4,217,067 | A | 8/1980 | Lagodka et al. | |
| 4,227,833 | A | 10/1980 | Plester et al. | |
| 4,255,071 | A | 3/1981 | Koppers et al. | |
| 4,272,129 | A | 6/1981 | Pearey | |
| 4,330,226 | A | 5/1982 | Welzel et al. | |
| 4,372,618 | A | 2/1983 | Pearey | |
| 4,386,878 | A | 6/1983 | Martinko et al. | |
| 4,416,566 | A | 11/1983 | Szebenyi et al. | |
| 4,465,406 | A | 8/1984 | Beckmann | |
| 4,480,946 | A | 11/1984 | Kelley | |
| 4,526,495 | A | 7/1985 | Becker et al. | |
| 4,547,098 | A | 10/1985 | Martinko et al. | |
| 4,557,635 | A | 12/1985 | Watermann et al. | |
| 4,662,796 | A | 5/1987 | Fanget | |
| 4,900,091 | A | 2/1990 | Neu | |
| 7,331,735 | B2 | 2/2008 | McKenzie | |

FOREIGN PATENT DOCUMENTS

| | | | |
|---|---|---|---|
| AU | 2003271396 | | 9/2004 |
| AU | 2005227376 | | 6/2006 |
| AU | 2005242116 | | 6/2006 |
| AU | 2005203458 | | 12/2006 |
| AU | 2008200303 | | 8/2008 |
| CN | 1261126 | | 7/2000 |
| CN | 2396183 | | 9/2000 |
| CN | 2420422 | | 2/2001 |
| CN | 1296116 | | 5/2001 |
| CN | 1301956 | | 7/2001 |
| CN | 1310285 | | 8/2001 |
| CN | 1786420 | | 6/2006 |
| CN | 1858402 | | 11/2006 |
| CN | 1888390 | | 1/2007 |
| CN | 1896460 | | 1/2007 |
| CN | 1932240 | | 3/2007 |
| CN | 100999997 | | 7/2007 |
| CN | 101082283 | | 12/2007 |
| CN | 101117894 | | 2/2008 |
| CN | 101161990 | | 4/2008 |
| CN | 101201004 | | 6/2008 |
| EP | 0250286 | | 9/1991 |
| GB | 1340491 | | 12/1973 |
| GB | 2088458 | A * | 6/1982 |
| RU | 2273733 | | 4/2006 |
| RU | 2283430 | | 9/2006 |
| RU | 2284414 | | 9/2006 |
| RU | 2303694 | | 7/2007 |
| RU | 2325528 | | 5/2008 |

OTHER PUBLICATIONS

Andrew Rutherford & Horst Ringleff, Australia's First LTCC Face Operation, Coal International magazine, Sep./Oct. 2007, pp. 18-24.

Bucyrus, Roof Support Systems, brochure, Apr. 2008, 7 pages, vol. 1.

Duncan, G. et al., "Top Coal Caving Longwall Maximizes Thick Seam Recovery," Mining Media's Longwall USA 2007 Conference & Exhibition, Jun. 2007, Pittsburgh, PA., 9 pages, retrieved from the Internet <URL: http://www.womp-int.com/story/2007vol5/story025.htm>.

* cited by examiner

LONGWALL MINING ROOF SUPPORTS

TECHNICAL FIELD

This disclosure relates to a system including a machine for winning mining material, a forward conveyor, and a roof support. More particularly, this disclosure relates to such a system that also includes a rear conveyor.

BACKGROUND ART

A variety of different apparatuses exist for mining coal and other materials from underground seams. One apparatus that is commonly used in underground mining operations comprises a mining machine used in instances where extended portions or longwalls of seam are to be mined. Such longwalls may, depending upon the seam configuration, extend for distances of 1200-1500 feet. It is standard practice in this type of mining to mine parallel entries into the seam to be mined and connect those entries with one or more primary passages. This procedure defines the longwall pillar(s) to be mined. The roof of the primary passages is then supported by movable roof supports during the mining of the exposed "face" of the longwall pillar.

Conventional longwall mining techniques employ a mining machine that is known in the industry as a longwall shearer. In alternate arrangements, a plough is used instead of a longwall shearer.

A longwall shearer typically has an elongated mobile frame that is supported on floor-mounted tracks that are adjacent and substantially parallel to the mine face. Rotary driven toothed drums are operably supported on arms on each end of the elongated frame for winning the coal as the frame passes back and forth before the mine face. The won material falls onto a face conveyor that is attached to the floor-mounted tracks and extends parallel to the longwall face. The face conveyor discharges the material onto other conveying apparatuses to transport the material from the seam. As the mine face recedes, the conveyor and track assembly is advanced forward to enable the shearer to continue mining.

FIG. 1 illustrates a conventional longwall system 10 having a mining machine in the form of a shearer 12 (carried on a face conveyor 14) and a cantilevered roof support 16. As the longwall system 10 advances through the panel 18, the self-advancing roof supports 16 advance toward the face 20 in a well-known manner.

More particularly, the cantilevered roof support 16 is a chock roof-engaging beam support unit having a floor-engaging base 42 and a shield 24 supported by two hydraulically operable support legs or rams 28 (only one of which is shown) spaced from the face conveyor to define an access travelling way 30. A roof-engaging beam 32 is pivotally attached at 34, to the shield 24 and the shield 24 is connected by cantilevered linkage 40 to the base 42. The roof-engaging beam 32 also carries at its front end a face sprag assembly 48 including a contact plate 50 that is shown in a face-supporting mode, where the plate 50 is extended from its stowed position by a hydraulic cylinder 54 to a position where it abuts a part of the face. The face sprag assembly's fully extended position is shown in ghost in FIG. 1.

The shearer 12 has a mining machine support in the form of an elongated mobile frame 60 with a skid-type shoe 64 that is movably supported on a race 68 that is substantially parallel with the longwall face. A laterally extending rotary drum 70 which has a plurality of mining bits 74 attached thereto is pivotally attached to each end of the elongated mobile frame 60 by a corresponding boom member 78. The operation of the shearer 12 is well known in the mining art and, as such, will not be discussed in detail herein. However, the skilled artisan will appreciate that the shearer 12 is moved back and forth on the race 68 such that the mining bits 74 on the rotating drums 70 can be brought into engagement with the mine face to dislodge material there from. As the face recedes, the race 68 and shearer 12 are advanced towards the face to enable the mining process to be continued.

In some mining operations, as shown in FIG. 2, a longwall operation includes an armored face conveyor 100 in front of the roof supports 104, and an armored face conveyor 108 behind the roof supports 104. The armored face conveyor 108 behind the roof supports 104 collects coal falling from above the roof supports, as the roof supports 104 advance. This form of mining is known as top coal or sub level caving. The tailgate roof support 104 used in such an operation includes a floor-engaging base 112, a pair of support legs 116 supporting a middle roof-engaging beam 118, a forward roof-engaging beam 120 pivotally connected to the middle roof-engaging beam 116, and a two-piece rearward roof-engaging beam 124 supported by another pair of support legs 128. The two-piece roof-engaging beam 124 at the rear of the roof support 104 covers the armored face conveyor 108 behind the roof support 104.

At the roadway or main gate end of the longwall, an extra wide and extra long roof support assembly 129 is required, and is illustrated in FIG. 3. The roof support assembly 129 includes two spaced apart roof supports 130. Each main gate end roof support 130 includes a rearward floor-engaging base or pontoon 134, a forward floor-engaging base or pontoon 138, and spaced apart support legs 142 are connected between each of the pontoons 134 and 138 and a respective roof-engaging beam 146 and 150. The rearward pontoon 138 also includes a shield 152 pivotally connected to the roof-engaging beam 146, and linkage 154 connects the shield 152 to the rearward pontoon 134. The forward pontoon 138 also includes a shield 158 pivotally connected to the roof-engaging beam 150, and linkage 164 connects the shield 158 to the forward pontoon 138. In other words, the main gate roof support 130 includes a forward facing roof support at one end, and a rearward facing roof support at the other end, with the two supports joined in the middle at 159. At the point of adjoining, each roof support carries a ram 168 and 172 that extends up to the respective roof support roof-engaging beam.

To assist in supporting the roof, each of the two roof supports 130 also include spaced apart middle plates 176 that extend between the two adjacent roof supports 130, creating an overlap. The overlapping middle plates 176 are not connected. The two adjacent roof supports 130 are used because each roof support has its own pontoons, for the floor of the mine is irregular as the roof support 130 advances. The pontoon of each roof support needs to be able to move vertically independently of the adjacent pontoon. Because the adjacent roof supports are not connected, it is difficult to maintain, as the roof support assembly 129 advances, the same roof support adjacent positions.

In the above-described typical top coal caving longwall mining operation, there are two drilling entries and a wall face across between the entries, with mining then being backwards along the entries. In a different form of mining, illustrated in FIGS. 4A and 4B, known as an advancing longwall system, the entire mining operation moves forward into the coal face. Only a single forward conveyor is used in such a system. A roadway 180, known as a gate road end, supporting the mining operation, needs to be cut and maintained separate from the longwall face. Construction of the gate road end adds complexity to the overall mining operation. When the gate road end 180 is being cut, a wall 184 has to be made to prevent the falling roof from entering the roadway. The difficulty of creating and supporting such a wall is significant. In order to reduce the amount of goaf pressure bearing against the man-made wall 184, fully roof-engaging beamed buttress supports 188 are provided at the gate road end 180 to reduce the goaf pressure on the man made wall 184.

DISCLOSURE OF INVENTION

Technical Problem

It is an object of this disclosure to provide an improved roof support for a top coal caving longwall operation.

Another object of this disclosure is to provide an improved top coal caving system with reduced goaf pressure on the end gates.

Another object of this disclosure is to provide improved top coal caving equipment.

Another object of this disclosure is to provide an improved main gate roof support with better shielding and operation.

Technical Solution

This disclosure thus provides a longwall mining system including at least one face end roof support having a longitudinal length, and at least one near end roof support adjacent the face end roof support. The near end roof support has a longitudinal length substantially shorter than the face end roof support longitudinal length. There is also at least one face roof support adjacent the near end roof support, and the face roof support has a longitudinal length substantially shorter than the near end roof support longitudinal length. There is also a forward conveyor extending forward to and attached to the face end roof support, the at least one near end roof support, and the at least one face roof support, and a rearward conveyor extending rearward of and attached to the face end roof support, the at least one near end roof support, and the at least one face roof support.

This disclosure also provides a roof support including a first floor-engaging base, a first shield, a first roof-engaging beam pivotally attached to the first shield, and a first hydraulically operable support leg connected between the first floor-engaging base and the first roof-engaging beam. First linkage pivotally connects the first shield to the first base. The roof support also includes a second floor-engaging base, adjacent but spaced apart from the first floor-engaging base, a second shield, a second roof-engaging beam pivotally attached to the second shield, and a second hydraulically operable support leg connected between the second floor-engaging base and the second roof-engaging beam. Second linkage pivotally connects the second shield to the second base, and a bridge is pivotally connecting to the first base and is pivotally connected to the second base.

Figure 1:
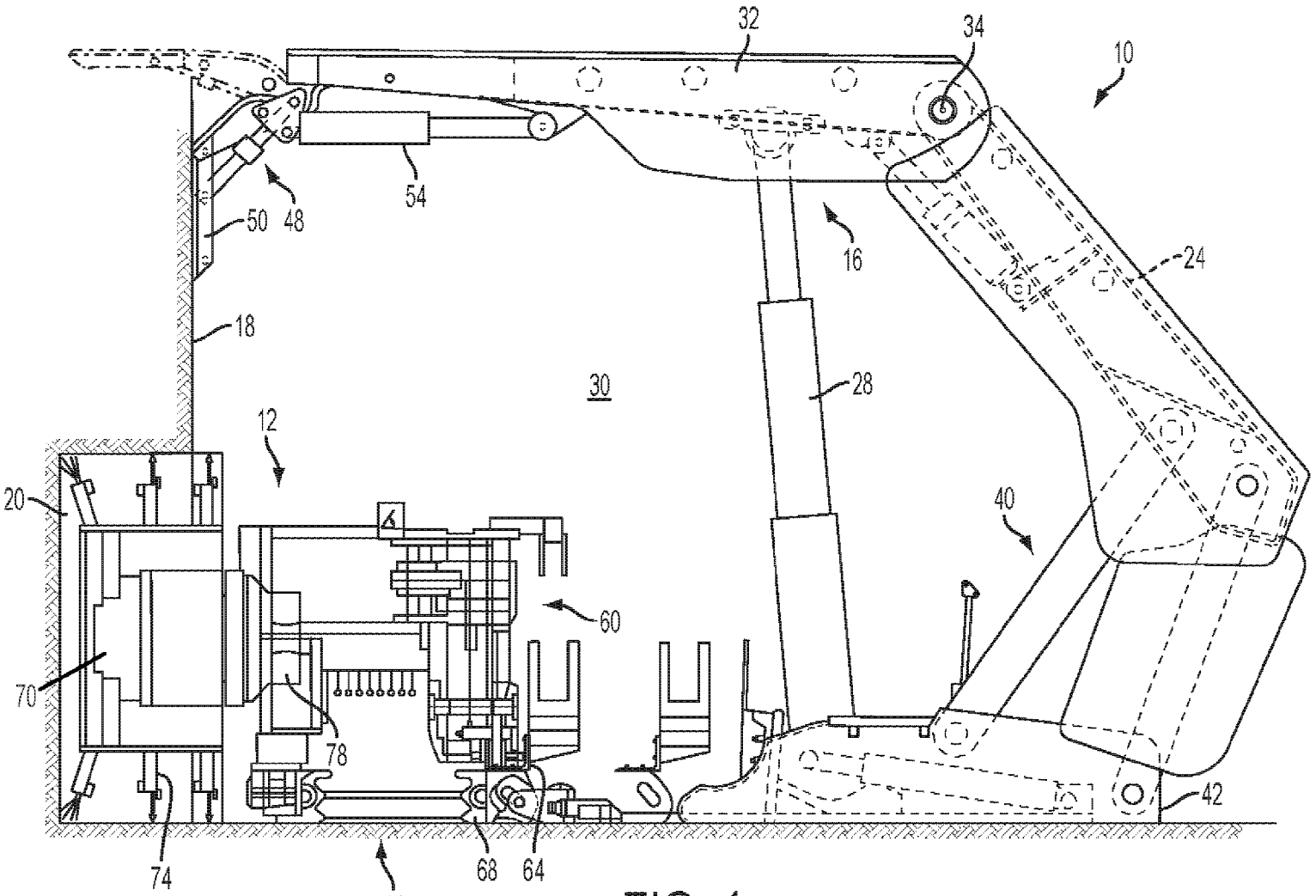
FIG. 1 PRIOR ART
FIG. 1 is a side view of a conventional roof support.
Figure 2:
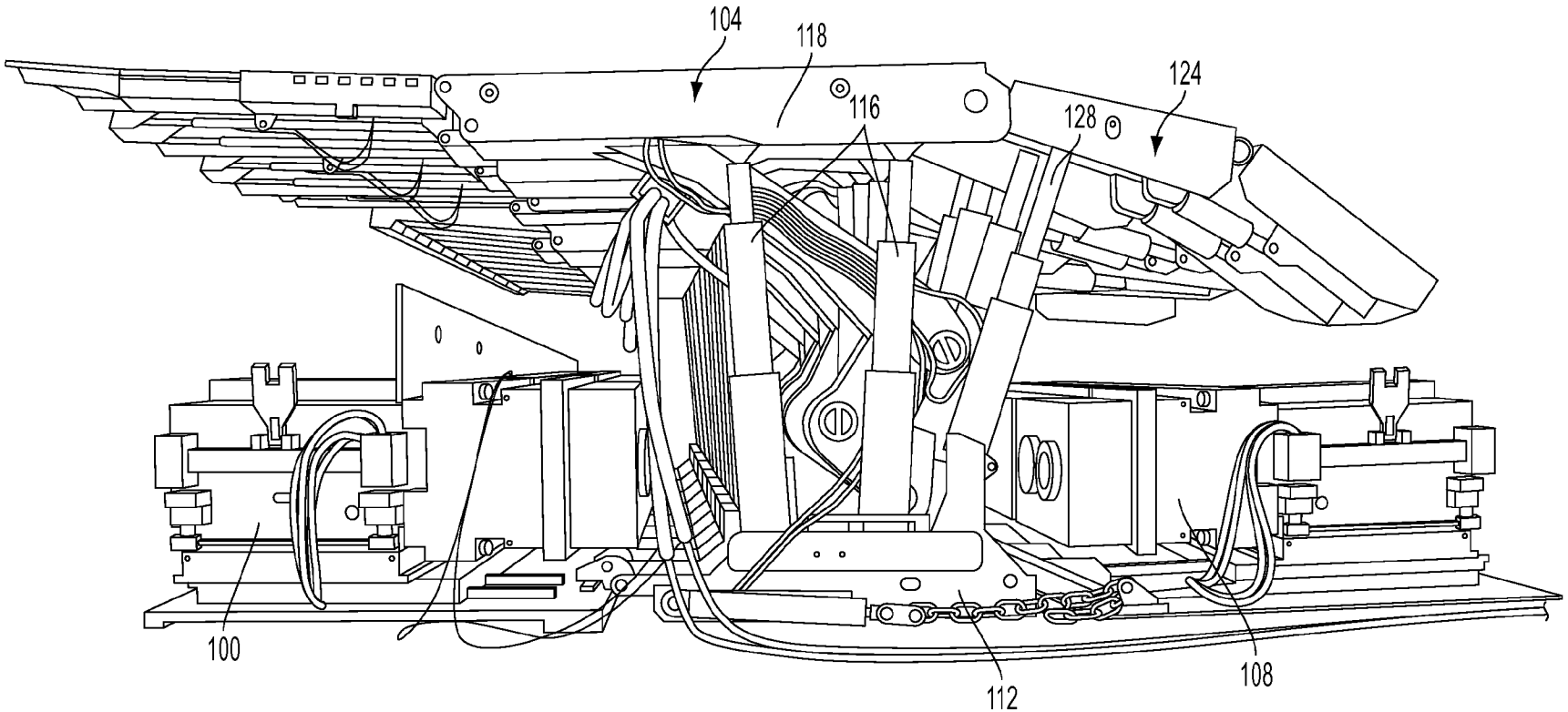
FIG. 2 PRIOR ART
FIG. 2 is a side view of a conventional tailgate end roof support.
Figure 3:
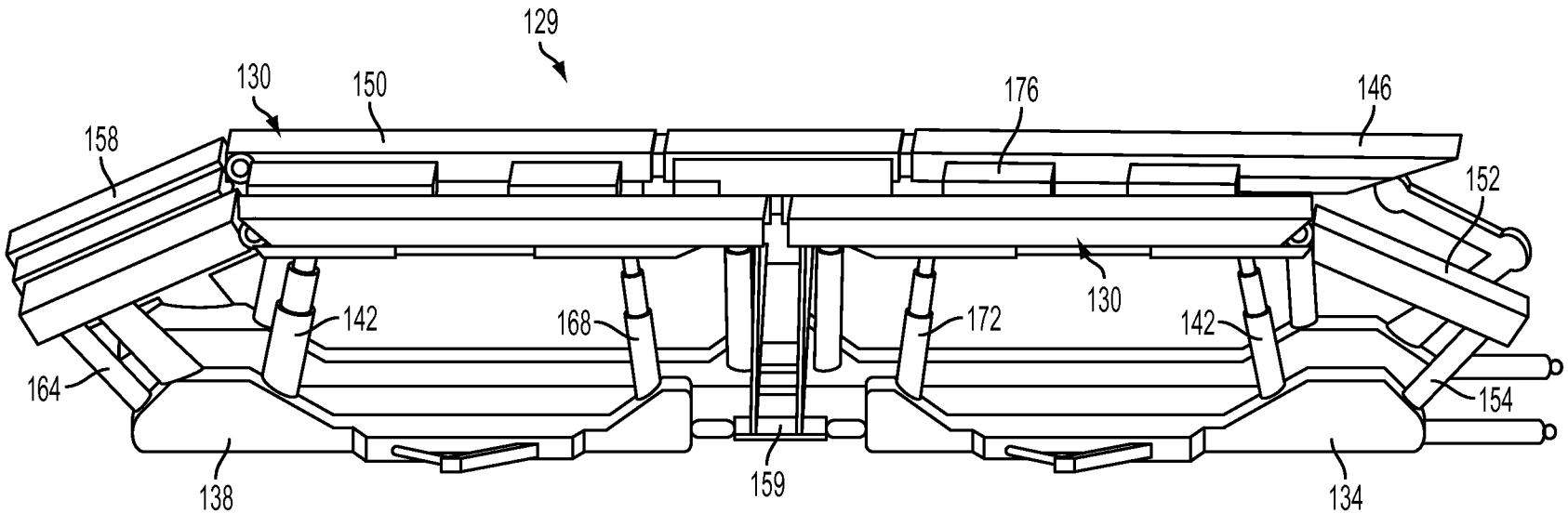
FIG. 3 PRIOR ART
FIG. 3 is a perspective view of a conventional main gate roof support.

Before one embodiment of the disclosure is explained in detail, it is to be understood that the disclosure is not limited in its application to the details of the construction and the arrangements of components set forth in the following description or illustrated in the drawings. The disclosure is capable of other embodiments and of being practiced or being carried out in various ways. Also, it is to be understood that the phraseology and terminology used herein is for the purpose of description and should not be regarded as limiting. Use of "including" and "comprising" and variations thereof as used herein is meant to encompass the items listed thereafter and equivalents thereof as well as additional items. Use of "consisting of" and variations thereof as used herein is meant to encompass only the items listed thereafter and equivalents thereof. Further, it is to be understood that such terms as "forward", "rearward", "left", "right", "upward" and "downward", etc., are words of convenience and are not to be construed as limiting terms.

Best Mode

Figure 5:
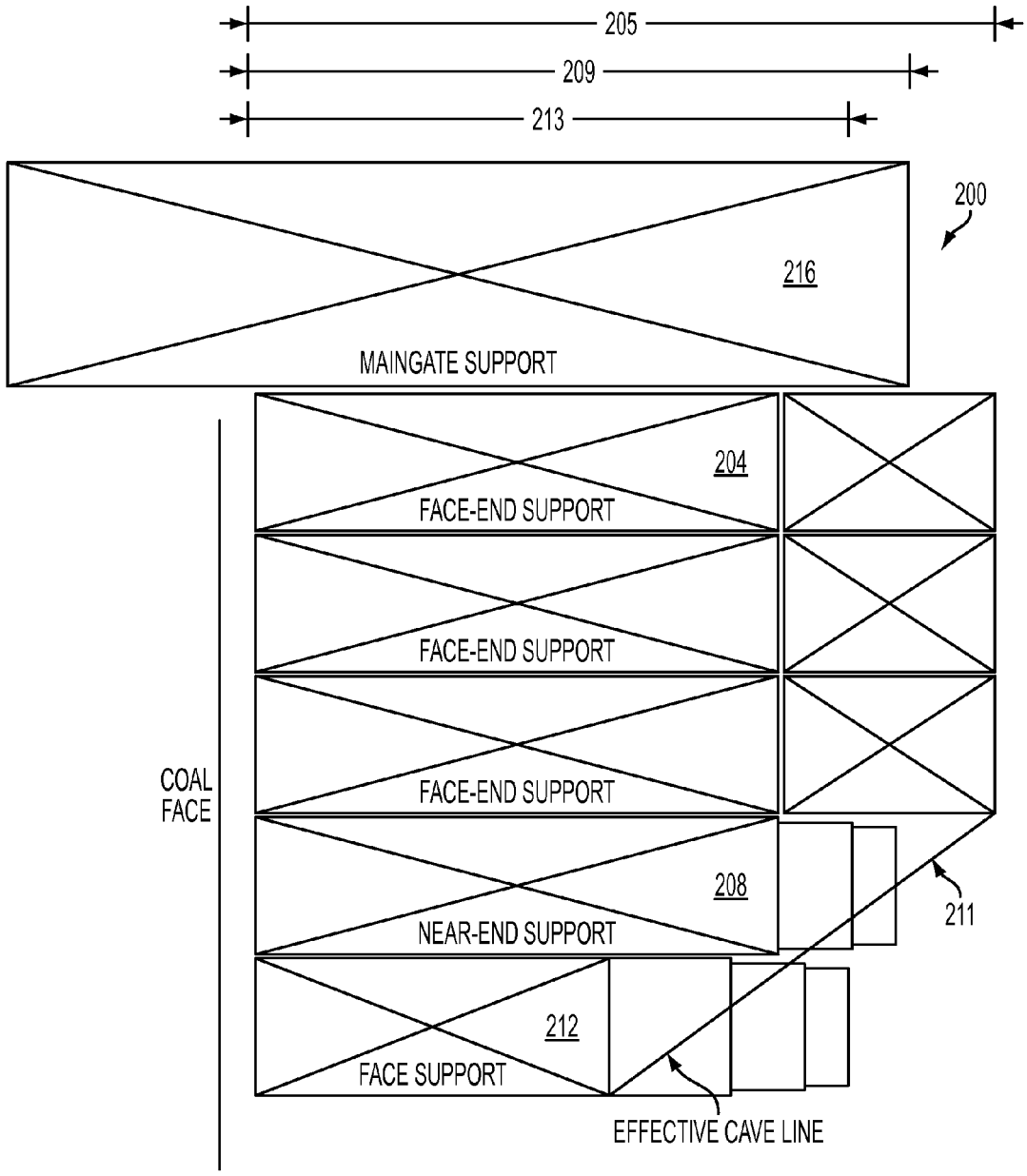
FIG. 5 is a top schematic view of a longwall mining system according to this disclosure.

FIG. 5 is a schematic illustration of various roof supports that make up a longwall system according to this disclosure. The longwall mining system 200 includes at least one face end cantilevered roof support 204, a near end cantilevered roof support 208 adjacent the face end roof support 204, and at least one conventional face cantilevered roof support 212 adjacent the near end roof support 208. More particularly, in the illustrated embodiment, the longwall system includes three face end roof supports 204, one near end roof support 208, and at least one roof support 212. Several of the roof supports 212 typically present beside the roof support 212 are not shown, but are understood to be present. A main gate roof support 216 is also present, adjacent the longwall system end with the three face end supports 204.

In the illustrated embodiment of FIG. 5, the face end roof support 204 has a longitudinal length 205, and the near end roof support 208 has a longitudinal length 209 substantially shorter than the face end roof support longitudinal length 205. The face roof support 212 also has a longitudinal length 213, and it is substantially shorter than the near end roof support longitudinal length 209. This creates an effective cave line 211 at an angle to the coal face, that helps reduce the goaf pressure on the face end, thereby increasing the stability of the main gate roof support 216.

Figure 4A:
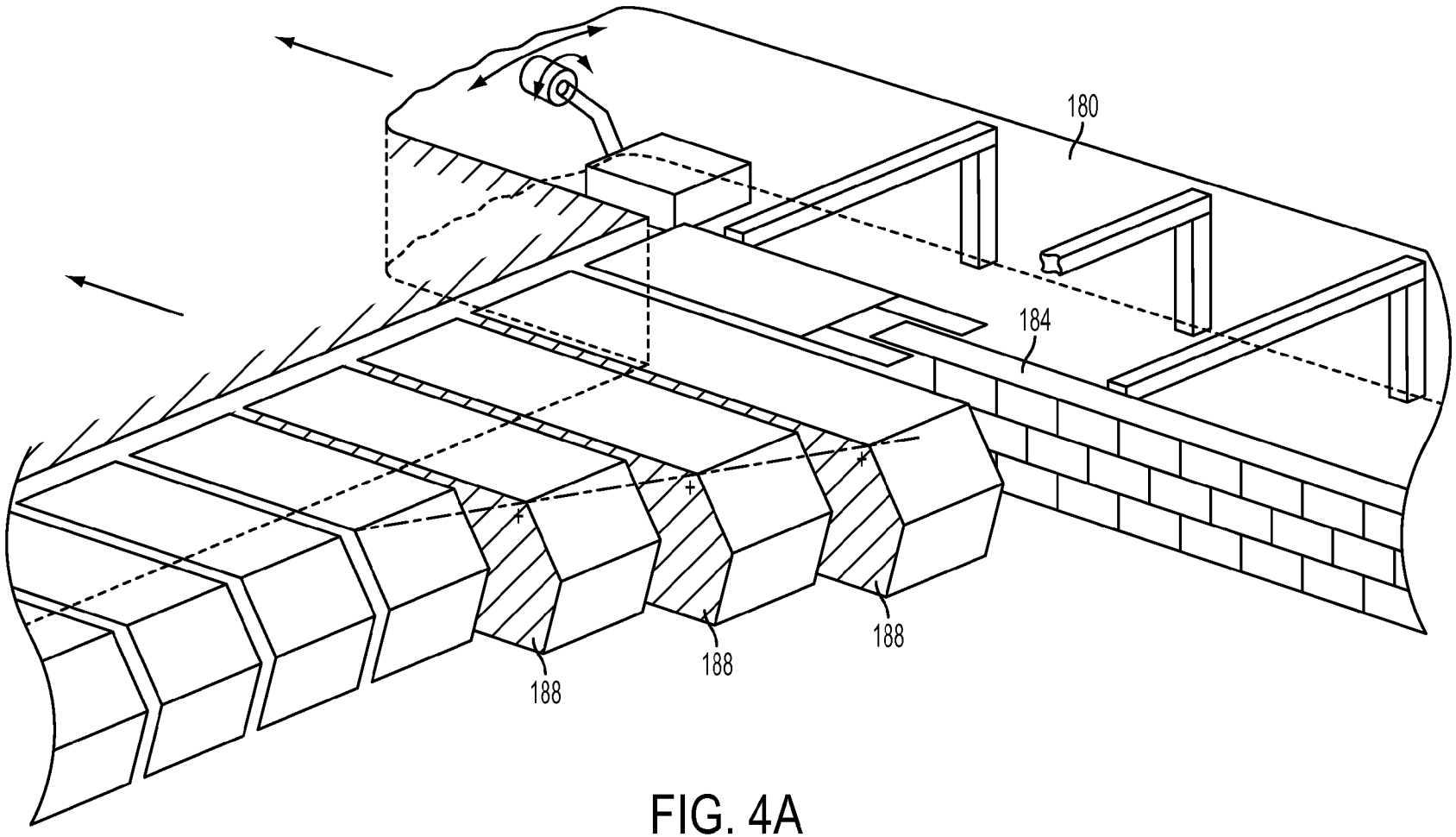
FIG. 4A PRIOR ART
FIG. 4A is a schematic perspective view of a prior art longwall mining method known as an advancing longwall.
Figure 4B:
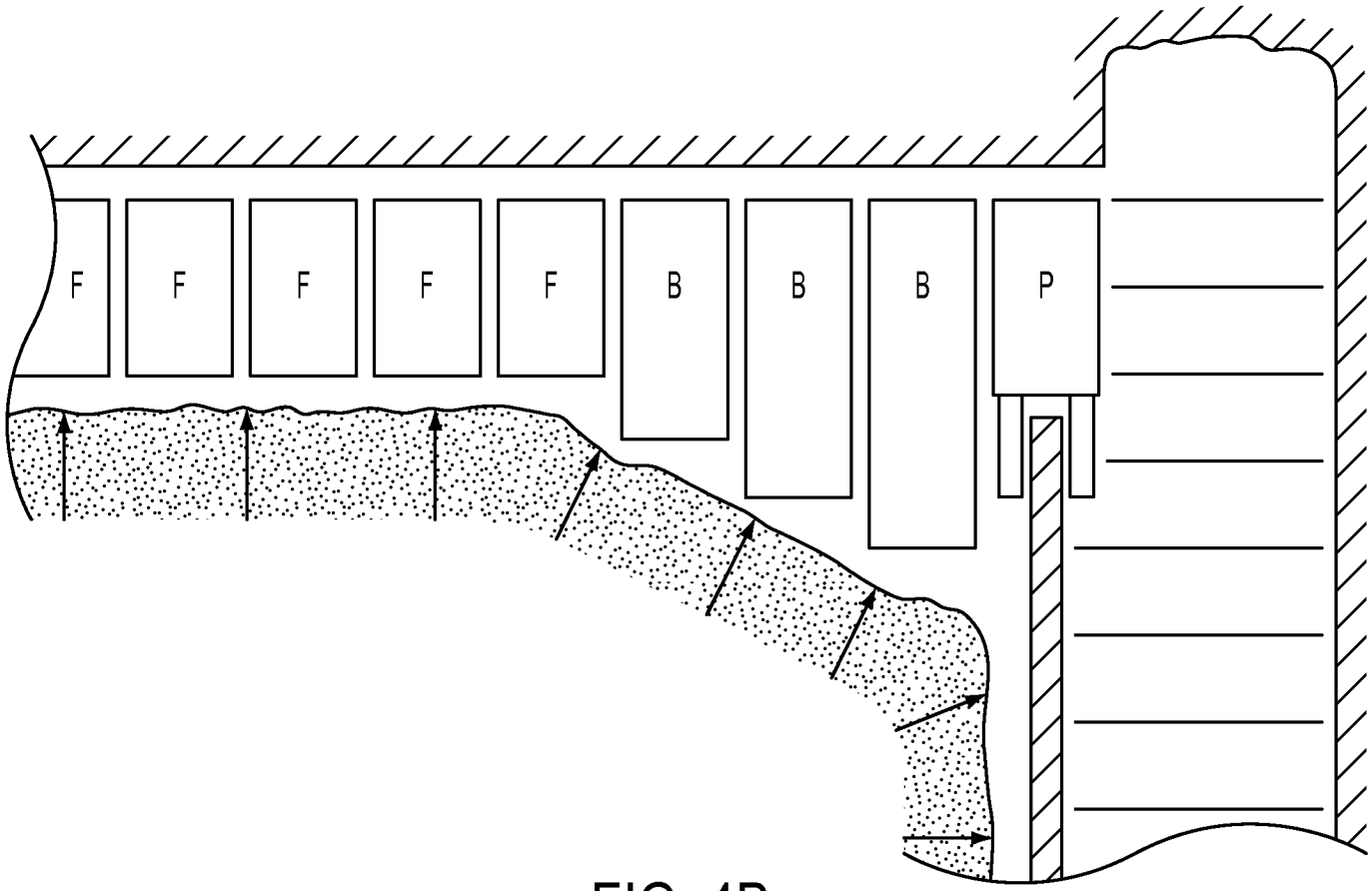
FIG. 4B PRIOR ART
FIG. 4B is a top schematic view of the prior art longwall advancing mining method shown in FIG. 4A.
Figure 6:
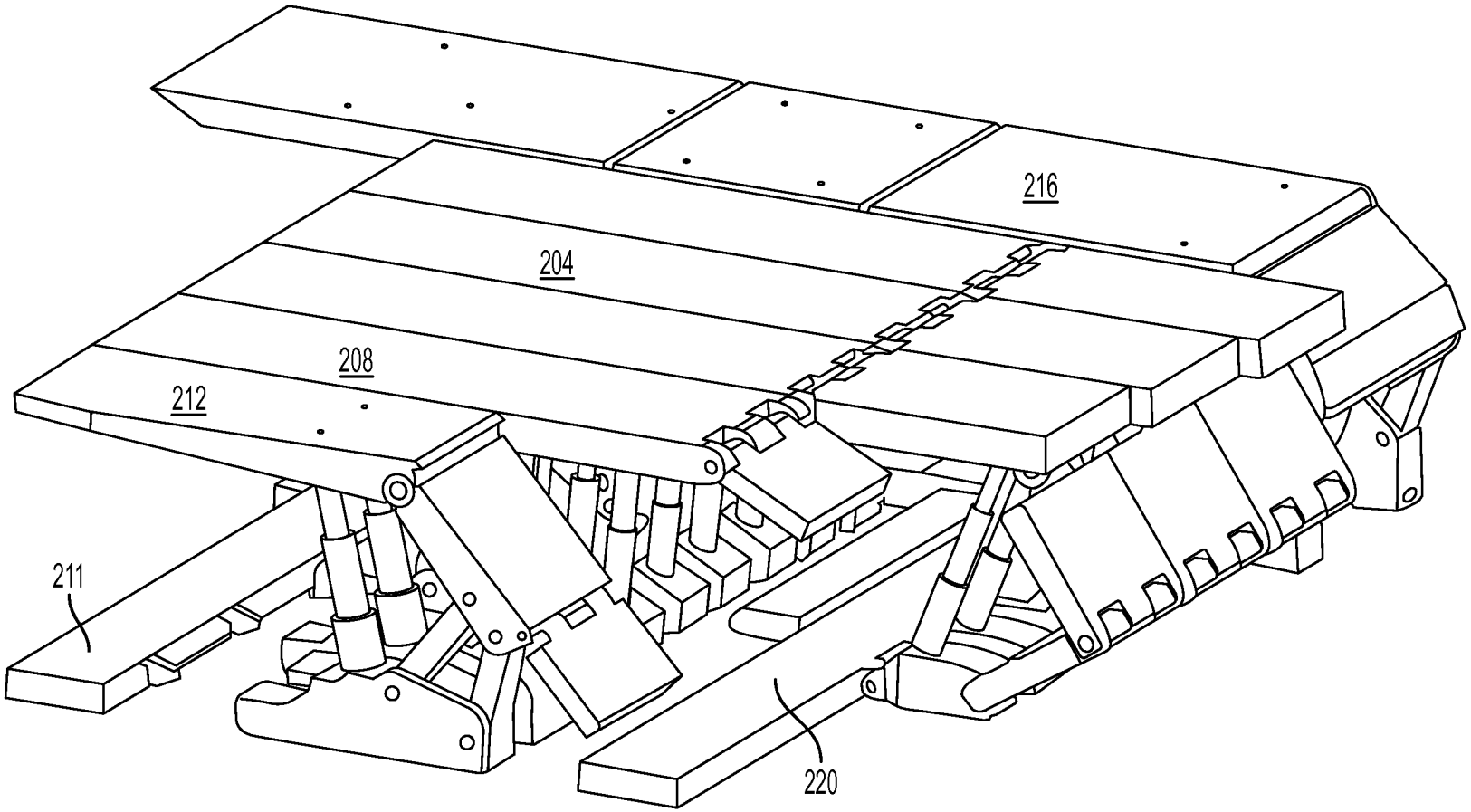
FIG. 6 is a schematic perspective view of the longwall mining system shown in FIG. 5.
Figure 7A:
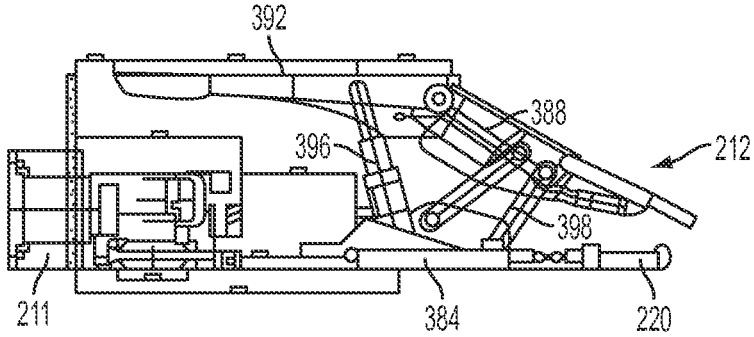
FIG. 7A is a side view of a conventional top coal caving face roof support.
Figure 7B:
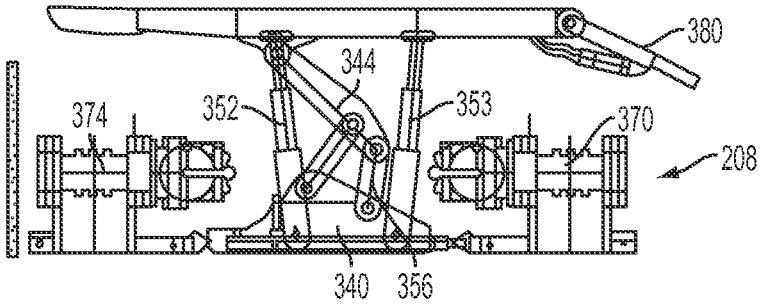
FIG. 7B is a side view of a near end roof support according to this disclosure.
Figure 7C:
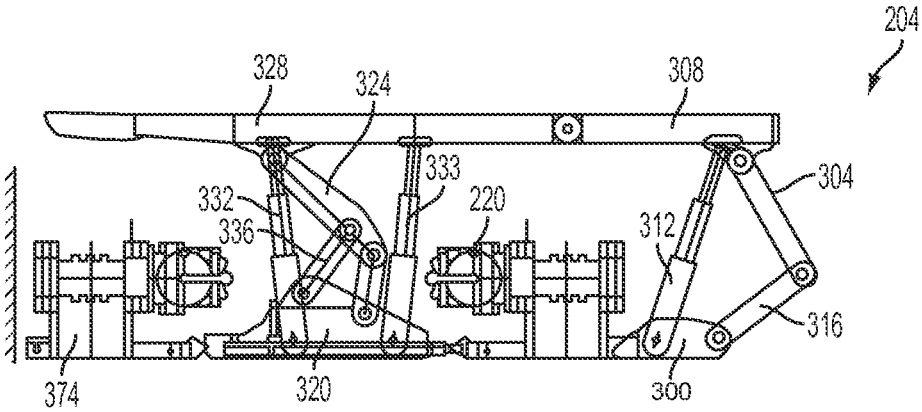
FIG. 7C is a side view of a end face roof support according to this disclosure.

A perspective schematic view of the roof supports is illustrated in FIG. 6, showing forward armored face conveyors 211, and rearward armored face conveyors 220. FIGS. 7A, 7B and 7C illustrate side views of the three different kinds of face end supports shown in FIG. 4. The conventional face support 212 is shown in FIG. 7A, and is essentially the same as that described in connection with FIG. 1, only with the addition of a tailpiece 218 that covers the rearward armored conveyor 220. In FIG. 7B is the near end roof support 208, and in FIG. 7C is the face end support 204, according to this disclosure.

Figure 8:
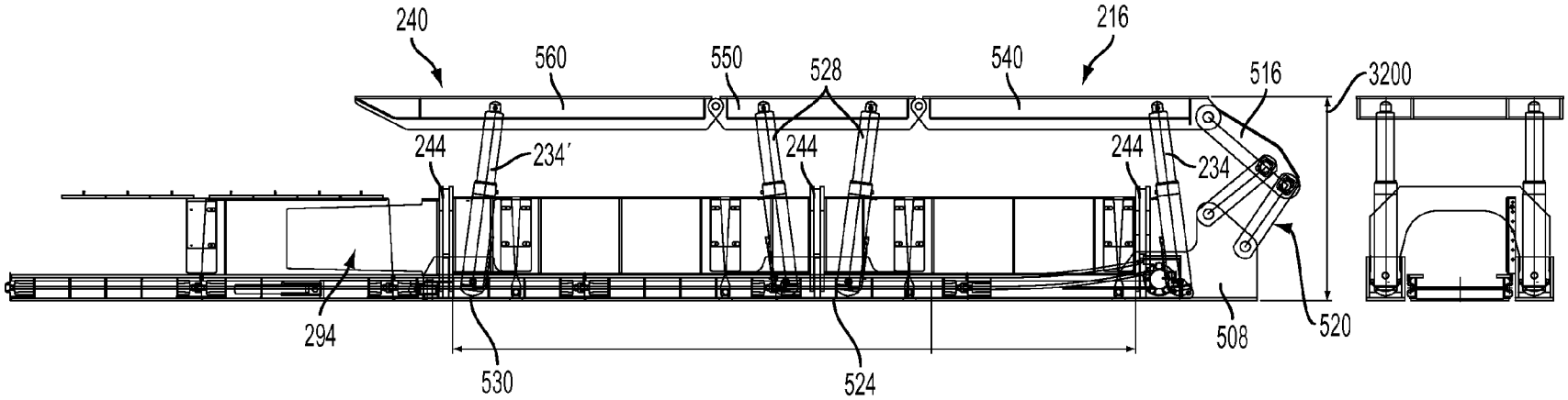
FIG. 8 is a side view of a longwall main gate roof support assembly according to this disclosure.
Figure 9B:
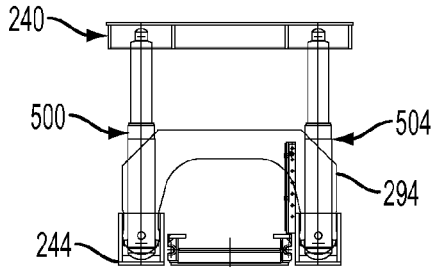
FIG. 9B is an end view of the longwall main gate roof support assembly shown in FIG. 8.
Figure 11:
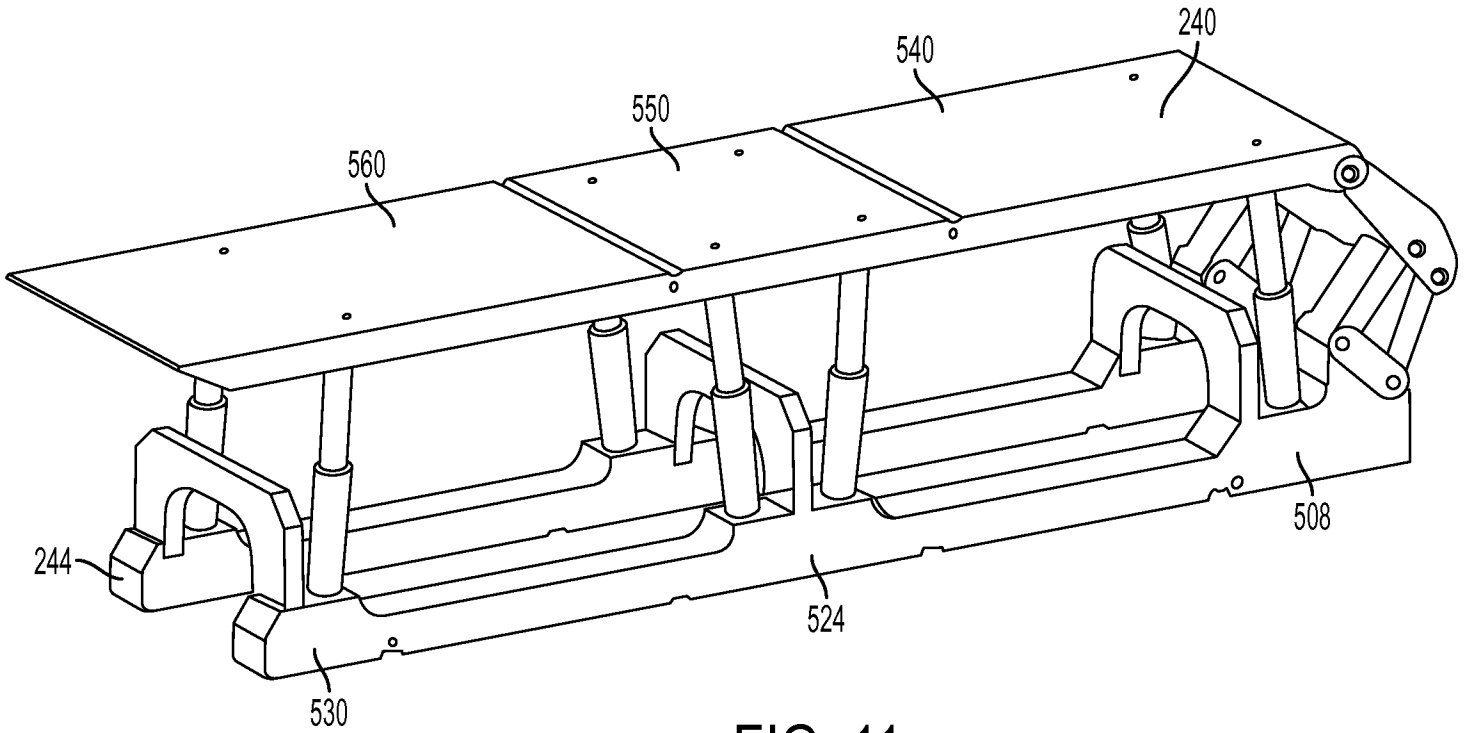
FIG. 11 is a schematic perspective view of the main gate roof support assembly shown in FIG. 8, without a sloughing plate.

FIG. 8 is a side view of the main gate roof support 216. The main gate support is similar to a conventional main gate support, but with a couple of important differences. As in the conventional support, the main gate support includes at one pair of separate but adjacent floor-engaging bases or pontoons 230 and 232 (see FIGS. 9A and 9B). Each of the pontoons 230 and 232 carries a support leg 234 and 234' (see FIG. 8) that is pivotally attached to the pontoon and pivotally attached to a roof roof-engaging beam. Unlike in the conventional main gate support, the two adjacent but spaced apart pontoons 230 and 232 support a single roof roof-engaging beam system 240 (see FIGS. 9B and 11) that spans both of the pontoons 230 and 232. In order to permit up and down movement of the pontoons 230 and 232 relative to each other, but to keep the pontoons adjacent to one another in the forward and reward movement directions, a pivotally attached bridge 244 spans the pontoons 230 and 232.

Figure 9A:
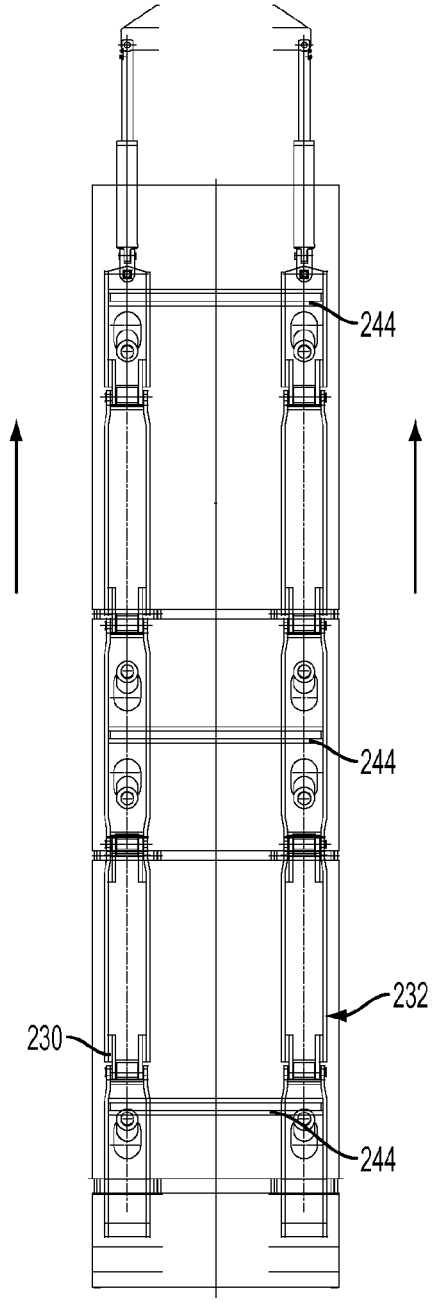
FIG. 9A is a top view of the longwall main gate face support shown in FIG. 8.
Figure 10:
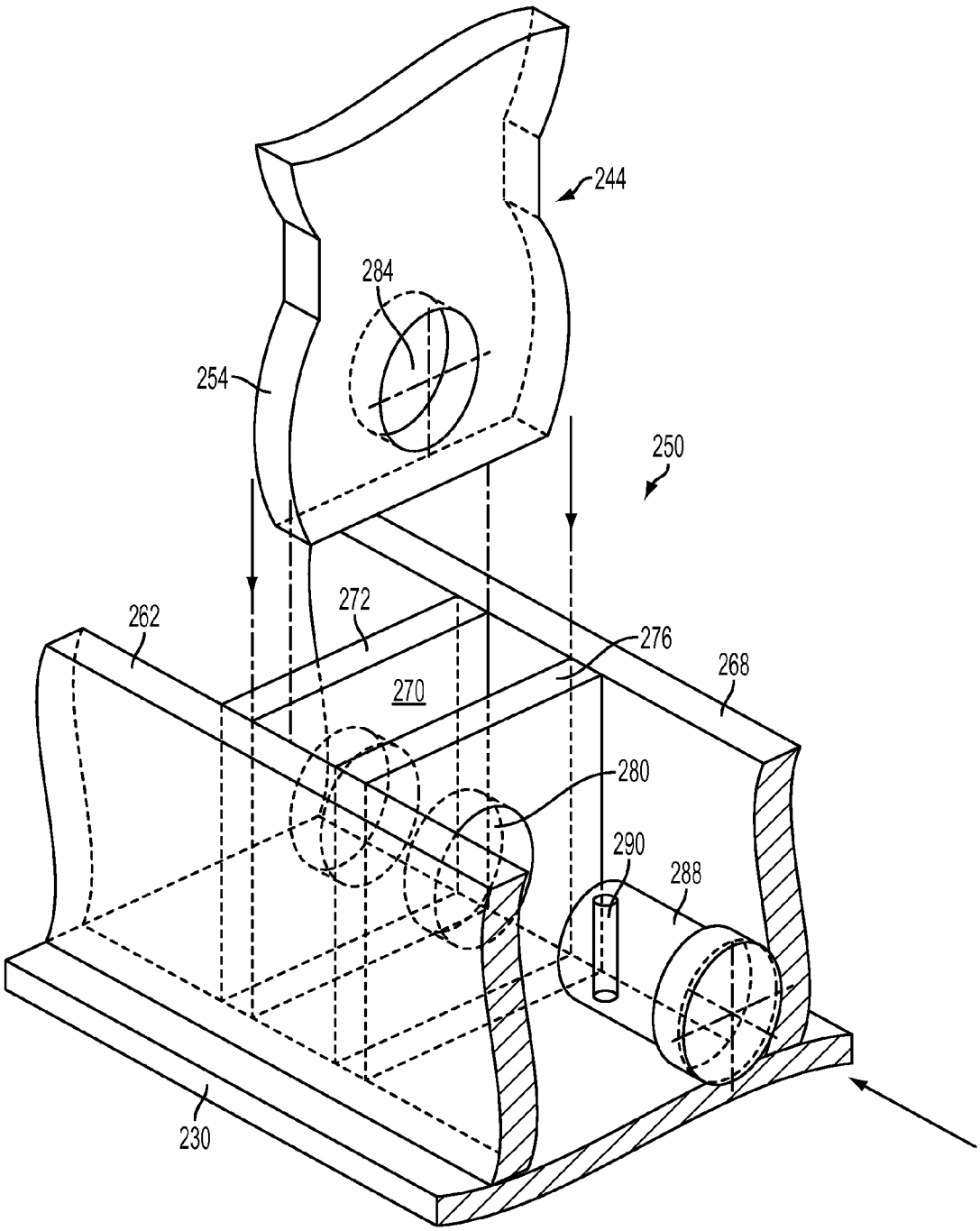
FIG. 10 is an unassembled perspective view of the legs of the bridge portion of the main gate roof support assembly shown in FIG. 8.

More particularly, the bridge 244 extends across the front of the pontoons, midway along the pontoons, and across the rear of the pontoons, as shown in FIGS. 8 and 9A. Each bridge 244 is attached to each pontoon at a joint 250, as shown in FIG. 10. More particularly, the bridge 244 is pivotally connected to each pontoon (for example, pontoon 230) by the rigid joint 250, and this joint 250 maintains the adjacent pontoons in side-by-side relationship, while at the same time permitting up and down movement of the pontoons relative to each other. Still more particularly, each end of the bridges 244 includes a leg or male member 254 received in a female member or pocket 270 attached to a pontoon. The pocket 270 comprises two spaced apart rigid plates 262 and 268, and two spaced apart walls 272 and 276, that extend perpendicular to the plates 262 and 268, and between the plates 262 and 268. The combination of the plates and walls form the pocket 270 that receives the bridge leg 254. An opening 280 extends through the joint walls 272 and 276, and a corresponding opening 284 in the bridge leg 254 aligns with the openings 280 in the joint walls when the bridge leg 254 is received in the pocket 270. A bolt 288 is provided for extending through the openings 280 and 284 securing the bridge leg 254 within the pocket 270. Means for securing the bolt 288 in the pocket 270 in the form of a Cotter pin 290 is provided at the end of the bolt 288 to secure the bolt 288 in the joint 250. When received in the pocket 270, the leg 254 is spaced apart from the pontoon 230, so that the leg 254 can rotate about the bolt 288 in the pocket 270.

A jointed sloughing plate 294 (see FIG. 8) attached to the outward pontoon of the main gate roof support 216, and away from the other roof supports, provides a further enhancement. The sloughing plate extends the full-length of the main gate roof support 216, and provides extra protection to the roadway.

Turning now to the details of the various roof supports shown in FIGS. 5 through 10, the face end roof support 204 includes a rearward floor-engaging base 300, a rearward shield 304, a rearward roof-engaging beam 308 pivotally attached to the shield 304, and two spaced apart hydraulically operable rearward support legs 312 (only one is shown) connected between the rearward floor-engaging base 300 and the rearward roof-engaging beam 308. The face end roof support further includes rearward linkage 316 pivotally connecting the rearward shield 304 to the rearward base 300, a forward floor-engaging base 320, a forward shield 324, and a forward roof-engaging beam 328 pivotally connected to the rearward roof-engaging beam 308. Four spaced apart hydraulically operable forward support legs spaced apart in pairs 332 and 333 forward and rearward are connected between the forward floor-engaging base 320 and the forward roof-engaging beam 328, and cantilevered linkage 336 pivotally connects the rearward shield 324 to the forward base 320.

The near end cantilevered roof support 208 includes a floor-engaging base 340, a shield 344, a roof-engaging beam 348 pivotally attached to the shield 344, and four spaced apart hydraulically operable forward support legs 352 connected between the floor-engaging base 340 and the roof-engaging beam 348. The near end roof support 208 also includes cantilevered linkage 356 pivotally connecting the shield 344 to the base 340, and two spaced apart hydraulically operable rearward support legs 353 connected between the floor-engaging base 340 and the roof-engaging beam 348. The rearward support legs 364 are spaced apart from the two spaced apart hydraulically operable forward support legs 352.

The near end roof support 208 also includes a rearward conveyor drive 370 pivotally connected to the floor-engaging base 340, the floor-engaging base 340 being pivotally connected to the rearward conveyor drive 370, and a forward conveyor drive 374, the floor-engaging base 340 also being pivotally connected to the forward conveyor drive 374. The near end roof support also includes a short pivoting roof-engaging beam or tailpiece 380 at the rear of the unit.

The face support comprises a floor-engaging base 384, a shield 388, a roof-engaging beam 392 pivotally attached to the shield 388, and two spaced apart hydraulically operable support legs 396 (only one is shown) connected between the floor-engaging base 384 and the roof-engaging beam 392. Cantilevered linkage 398 pivotally connects the shield 388 to the base 384.

The main gate roof support 216 includes two spaced apart sides 500 and 504 (see FIG. 9B), with each side comprising a rearward floor-engaging base 508, a hydraulically operable rearward support leg 234 connected to the rearward floor-engaging base 508, and a rearward shield 516. Rearward cantilevered linkage 520 pivotally connects the rearward shield 516 to the rearward base 508. A middle floor-engaging base 524 is connected to the rearward floor-engaging base 508, and hydraulically operable middle support legs 528 are connected to the middle floor-engaging base 524. A forward floor-engaging base 530 is pivotally connected to the middle floor-engaging base 524, and a hydraulically operable forward support leg 234' is connected to the forward floor-engaging base 530.

The main gate roof support 216 further includes a rearward roof-engaging beam 540 pivotally attached to the rearward shield 516, and the spaced apart hydraulically operable rearward support legs 234 of the sides are connected between the rearward floor-engaging bases 508 and the rearward roof-engaging beam 540. A middle roof-engaging beam 550 is pivotally connected to the rearward roof-engaging beam 540, and the spaced apart hydraulically operable middle support legs 528 of the sides are connected between the middle floor-engaging bases 524 and the middle roof-engaging beam 550. A forward roof-engaging beam 560 is pivotally attached to middle roof-engaging beam 550, and the spaced apart hydraulically operable forward support legs 234' of the sides are connected between the forward floor-engaging bases 530 and the forward roof-engaging beam 560. The forward, middle and rearward floor-engaging bases of each side combine to form each of the pontoons of the main gate support 216.

Figure 12A:
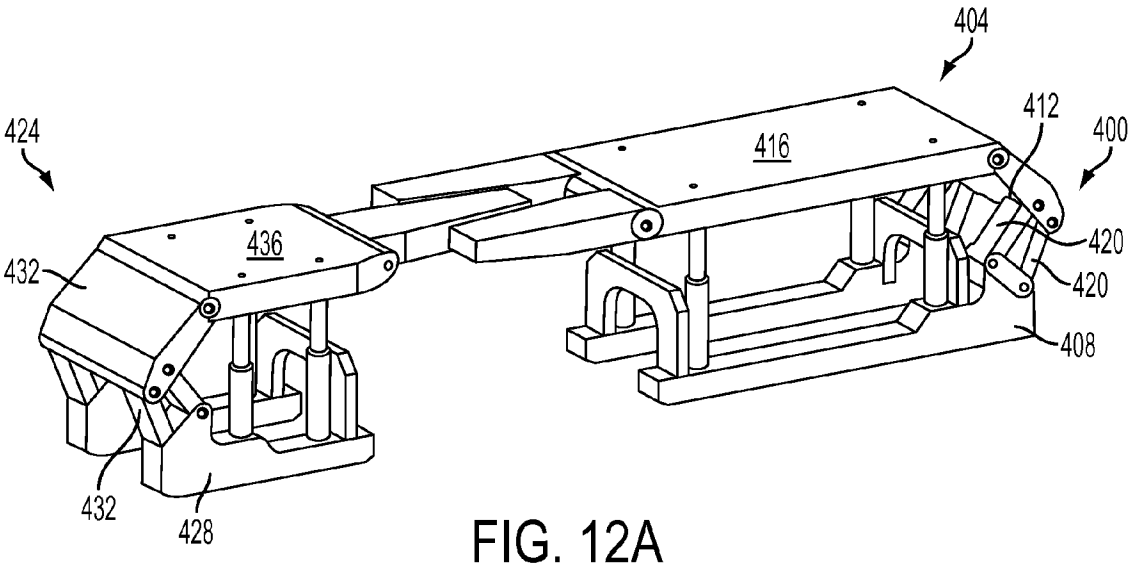
FIG. 12A is an alternate embodiment of the main gate roof assembly shown in FIG. 11.
Figure 12B:
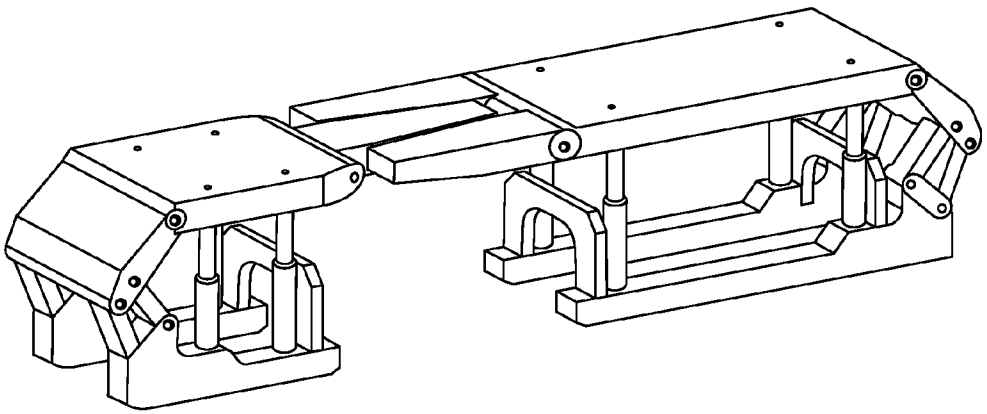
FIG. 12B is a perspective view of the main gate roof support assembly shown in FIG. 12A, with the roof support assembly shown in a web-advanced position.

In an alternate main gate roof support assembly 400, as shown in FIGS. 12A and 12B, a first cantilevered roof support 404 includes two spaced apart sides, with each side having a first floor-engaging base 408, a first shield 412, a first roof-engaging beam 416 pivotally attached to the first shield 412, and a first hydraulically operable support leg 420 connected between the first floor-engaging base 408 and the first roof-engaging beam 416. The first cantilevered roof support 404 also includes a first cantilevered linkage 420 pivotally connecting the first shield 412 to the first base 408. Facing the first roof support 404 is a second cantilevered roof support 424 including a second floor-engaging base 428, a second shield 432, and a second roof-engaging beam 436 pivotally attached to the second shield 432. The second roof-engaging beam 436 is adjacent the first roof-engaging beam 416 and interspersed within the first roof-engaging beam 416. A second hydraulically operable support leg 440 is connected between the second floor-engaging base 428 and the second roof-engaging beam 436, and a second cantilevered linkage 444 is pivotally connecting the second shield 428 to the second base 428. In the illustrated embodiment, another hydraulic hydraulically operable support leg is also connected between the second floor-engaging base 428 and the second roof-engaging beam 436. The roof-engaging beams and shields of each side of the roof supports 404 and 424 are integral plates that span and are connected to both sides of the roof supports.

More particularly, the first roof-engaging beam 416 comprises two spaced apart plates 450, and the second roof-engaging beam 436 comprises a plate 454 positioned between the first roof-engaging beam spaced apart plates 450. By virtue of being separate, not connected roof supports 404 and 424, the main gate roof support assembly 400 can advance one roof support, and then advance the other, to aid the longwall mining process.

Various other features of this disclosure are set forth in the following claims.

The invention claimed is:

1. A face end roof support including
a rearward floor-engaging base,
a rearward shield,
a rearward roof-engaging beam pivotally attached to the shield,
two spaced apart hydraulically operable rearward support legs connected between said rearward floor-engaging base and said rearward roof-engaging beam,
rearward linkage pivotally connecting said rearward shield to said rearward base,
a forward floor-engaging base,
a forward shield,
a forward roof-engaging beam pivotally connected to said rearward roof-engaging beam,
two spaced apart hydraulically operable forward support legs connected between said floor-engaging base and said forward roof-engaging beam, and
forward linkage pivotally connecting said forward shield to said forward base.

2. A face end roof support in accordance with claim 1 wherein said face end roof support further includes a second pair of spaced apart hydraulically operable forward support legs connected between said floor-engaging base and said forward roof-engaging beam, said second pair being spaced apart from said two spaced apart forward support legs.

3. A longwall mining system including:
a face end roof support including:
a rearward floor-engaging base,
a rearward shield,
a rearward roof-engaging beam pivotally attached to the shield,
two spaced apart hydraulically operable rearward support legs connected between said rearward floor-engaging base and said rearward roof-engaging beam,
rearward linkage pivotally connecting said rearward shield to said rearward base,
a forward floor-engaging base,
a forward shield,
a forward roof-engaging beam pivotally connected to said rearward roof-engaging beam,
two spaced apart hydraulically operable forward support legs connected between said forward floor-engaging base and said forward roof-engaging beam, and
forward linkage pivotally connecting said forward shield to said forward base,
a rearward conveyor drive pivotally connected to said rearward floor-engaging base, and
a forward conveyor drive pivotally connected to said forward floor-engaging base.

4. A longwall mining system in accordance with claim 3 wherein said face end roof support further includes a second pair of spaced apart hydraulically operable forward support legs connected between said forward floor-engaging base and said forward roof-engaging beam, said second pair being spaced apart from said two spaced apart forward support legs.

5. A longwall mining system in accordance with claim 3 wherein said rearward conveyor drive is disposed between said rearward floor-engaging base and said forward floor-engaging base.

6. A longwall mining system in accordance with claim 3 wherein said forward floor-engaging base is pivotally connected to said rearward conveyor drive.

* * * * *